US007878504B2

(12) United States Patent
Ikeda et al.

(10) Patent No.: US 7,878,504 B2
(45) Date of Patent: Feb. 1, 2011

(54) ROLLER MECHANISM AND IMAGE FORMING DEVICE

(75) Inventors: Kenji Ikeda, Kanagawa (JP); Hiroaki Satoh, Kanagawa (JP); Susumu Kibayashi, Kanagawa (JP); Toru Nishida, Kanagawa (JP); Takeshi Zengo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 383 days.

(21) Appl. No.: 12/041,001

(22) Filed: Mar. 3, 2008

(65) Prior Publication Data

US 2009/0045569 A1 Feb. 19, 2009

(30) Foreign Application Priority Data

Aug. 15, 2007 (JP) ..... 2007-211686

(51) Int. Cl.
*B65H 5/02* (2006.01)

(52) U.S. Cl. ..... 271/274; 271/273

(58) Field of Classification Search ..... 271/273, 271/274, 277, 272, 268
See application file for complete search history.

(56) References Cited

U.S. PATENT DOCUMENTS 3,413,915 A * 12/1968 Goodwin et al. ..... 100/169
3,428,308 A * 2/1969 Bernard ..... 271/273
3,552,742 A * 1/1971 Rooklyn ..... 271/274
3,994,487 A * 11/1976 Wicklund ..... 271/314
4,203,588 A * 5/1980 Joosten ..... 271/246
4,438,918 A * 3/1984 Ito et al. ..... 271/251
5,203,263 A * 4/1993 Berger et al. ..... 101/76
5,261,657 A * 11/1993 Edin ..... 271/274
5,346,199 A * 9/1994 Martin et al. ..... 271/110
5,949,470 A * 9/1999 Nakajima et al. ..... 347/262
6,186,499 B1 * 2/2001 Gross ..... 271/277
6,308,820 B1 * 10/2001 Munneke ..... 198/626.2
6,764,071 B2 * 7/2004 Hoberock ..... 271/109
7,355,763 B2 * 4/2008 Furihata ..... 358/474
2002/0066992 A1 * 6/2002 Lim et al. ..... 271/117
2003/0193126 A1 * 10/2003 Hoberock ..... 271/10.11
2005/0073573 A1 * 4/2005 Kerr et al. ..... 347/238
2007/0286645 A1 * 12/2007 Hayashi ..... 399/262

FOREIGN PATENT DOCUMENTS

JP 57198484 A * 12/1982

(Continued)

*Primary Examiner*—Stefanos Karmis
*Assistant Examiner*—Howard Sanders
(74) *Attorney, Agent, or Firm*—Fildes & Outland, P.C.

(57) ABSTRACT

A roller mechanism includes a pair of rollers and an urging unit. The pair of rollers oppose one another sandwiching a conveyance path of a sheet material, and are provided to be capable of increasing and reducing an axis-to-axis separation thereof. The urging unit urges at least one of the pair of rollers in a direction of reducing the axis-to-axis separation of the pair of rollers with an urging force that increases with an increase in the axis-to-axis separation of the pair of rollers, and presses the sheet material with the pair of rollers. The urging unit increases the urging force non-linearly, with a rate of increase of the urging force falling as the axis-to-axis separation of the pair of rollers increases within a range of changes at times of sheet material-pressing.

17 Claims, 11 Drawing Sheets

FOREIGN PATENT DOCUMENTS

| | | | |
|---|---|---|---|
| JP | 58-126561 | | 7/1983 |
| JP | 02117524 A | * | 5/1990 |
| JP | 3 172239 | | 7/1991 |
| JP | 11-52743 | | 2/1999 |
| JP | 2004064987 A | * | 2/2004 |

* cited by examiner

ROLLER MECHANISM AND IMAGE FORMING DEVICE

CROSS-REFERENCE TO RELATED APPLICATION

This application is based on and claims priority under 35 USC 119 from Japanese Patent Application No. 2007-211686 filed on Aug. 15, 2007.

BACKGROUND

1. Technical Field

The present invention relates to a roller mechanism and an image forming device.

2. Related Art

When a leading end of a sheet material is entering a nipping portion between a pair of rollers that are pushed together by urging members such as springs or the like, and when the trailing end of the sheet material is disengaging from the nipping portion, changes in speeds of rotation of the pair of rollers occur. These changes in rotation speed are larger when the sheet material is thicker. Moreover, a pressing force of the pair of rollers due to the springs changes in accordance with differences in thickness of sheet materials.

SUMMARY

A roller mechanism of a first aspect of the present invention includes: a pair of rollers that oppose one another sandwiching a conveyance path of a sheet material, and are provided to be capable of increasing and reducing an axis-to-axis separation thereof; and an urging unit that urges at least one of the pair of rollers in a direction of reducing the axis-to-axis separation of the pair of rollers with an urging force that increases with an increase in the axis-to-axis separation of the pair of rollers, and presses the sheet material with the pair of rollers, the urging unit increasing the urging force non-linearly, with a rate of increase of the urging force falling as the axis-to-axis separation of the pair of rollers increases within a range of changes at times of sheet material-pressing.

BRIEF DESCRIPTION OF THE DRAWINGS

Exemplary embodiment of the present invention will be described in detail based on the following figures, wherein:

FIG. 7 is a graph showing a relationship between thickness of paper and resilient force of a compression coil spring, and the like;

FIG. 8 is a graph showing a relationship between thickness of paper and urging force in which resilient force of a compression coil spring and magnetic force of a magnet are combined, or the like;

DETAILED DESCRIPTION

Herebelow, an exemplary embodiment of the present invention will be described with reference to the drawings.

Figure 1:
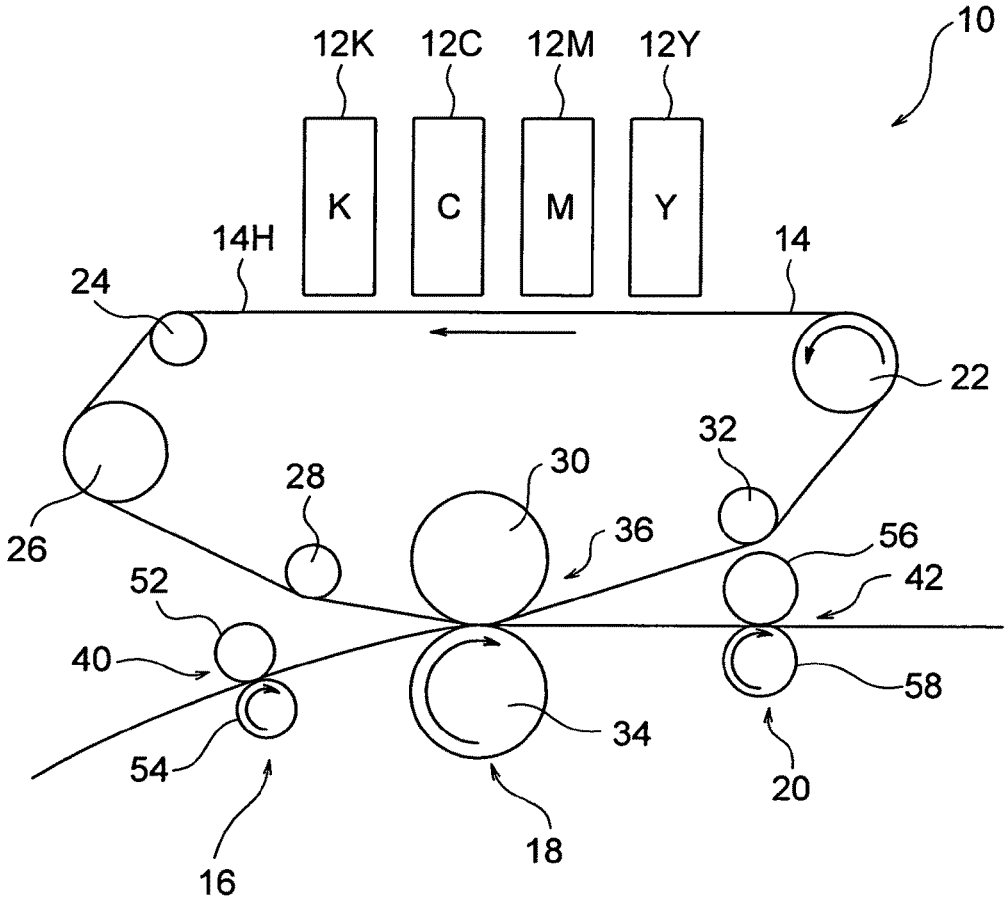
FIG. 1 is a side view showing schematics of an inkjet recording apparatus provided with a transfer roller mechanism relating to a first exemplary embodiment of the present invention.

FIG. 1 shows an inkjet recording apparatus 10 which serves as an image forming apparatus and is provided with a transfer roller mechanism 18, conveyance roller mechanism 16 and fixing roller mechanism 20 relating to a first exemplary embodiment of the roller of the present invention. The inkjet recording apparatus 10 is provided with inkjet recording heads 12Y, 12M, 12C and 12K and an intermediate transfer belt 14, winch stretches between a plurality of roller including a driving roller 22 and the like.

The intermediate transfer belt 14 is stretched in a polygonal shape by the driving roller 22 and a following roller 24, which are arranged horizontally, and following rollers 26, 28, 30 and 32, which are arranged therebelow. A horizontal portion 14H of the intermediate transfer ball 14, which stretches between the driving roller 22 and the following roller 24, extends substantially horizontally in a width direction and a turning direction. The inkjet recording heads 12Y, 12M, 12C and 12K oppose the horizontal portion 14H.

The driving roller 22 is rotated by a motor (not shown) and turns the intermediate transfer belt 14. The following rollers 26, 28, 32 and 32 rotate to follow the turning intermediate transfer belt 14.

Figure 2:
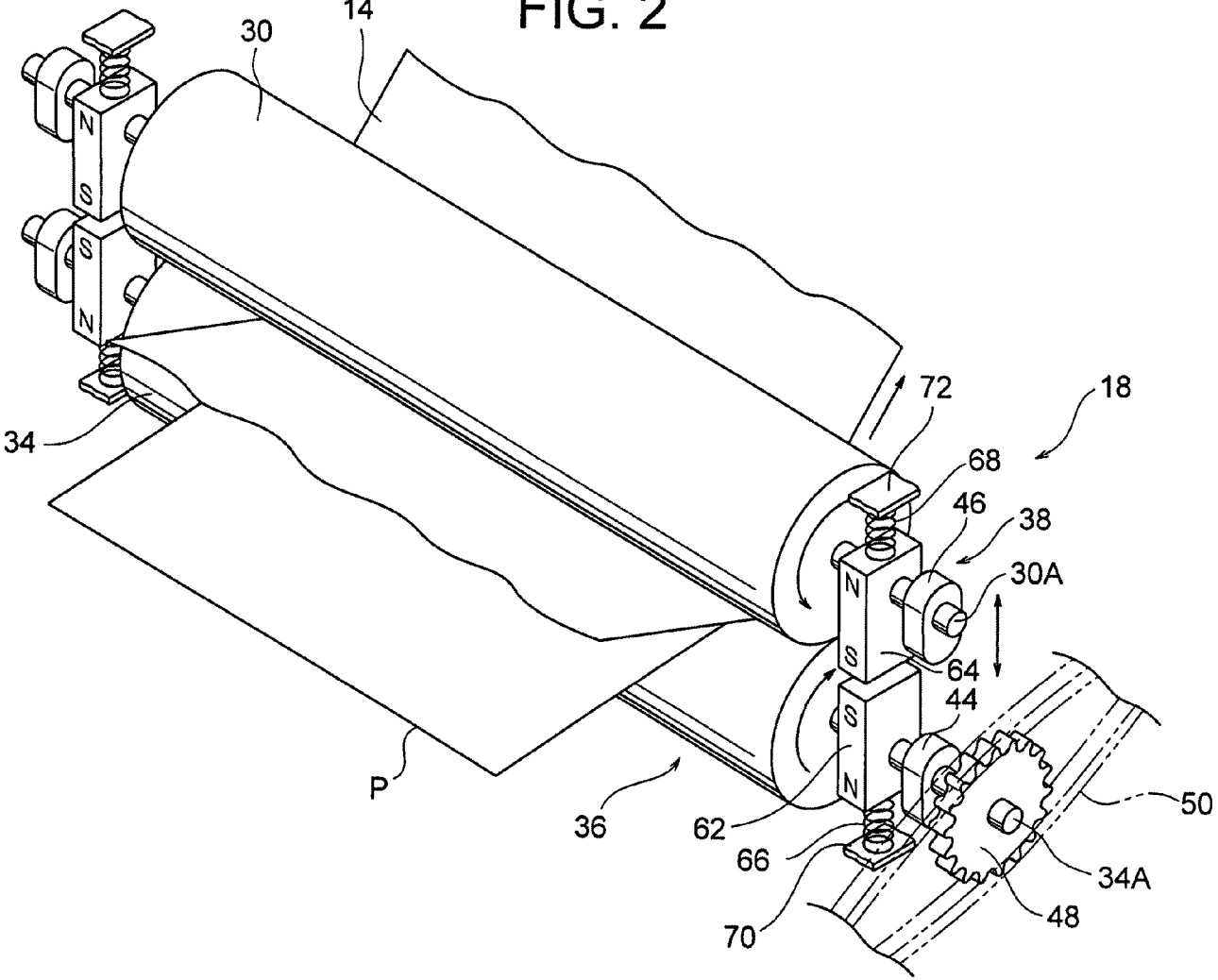
FIG. 2 is a perspective view showing the transfer roller mechanism relating to the first exemplary embodiment of the present invention.

Of the plurality of rollers stretching the intermediate transfer belt 14, the following roller 30 is disposed at a lowermost portion. The following roller 30 is provided in the above-mentioned transfer roller mechanism 18. The transfer roller mechanism 18 is provided with a transfer roller pair 36, which is structured by the following roller 30 and a transfer roller 34, and a pressing mechanism 38 (see. FIG. 2), which serves an urging unit for pressing the following roller 30 and the transfer roller 34 together.

The transfer roller pair 36 is disposed on a conveyance path of paper P, which serves as a recording medium. A conveyance roller pair 40, which is provided in the above-mentioned conveyance roller mechanism 16, is disposed at a conveyance direction upstream side relative to the transfer roller pair 36, and a fixing roller pair 42, which is provided in the above-mentioned fixing roller mechanism 20, is disposed at a conveyance direction downstream side relative to the transfer roller pair 36. The conveyance roller pair 40 is structured by a following roller 52 and a driving roller 54, which oppose one another in a vertical direction sandwiching the conveyance path of the paper P. The fixing roller pair 42 is structured by a following roller 56 and a driving roller 58, which oppose one another in a vertical direction sandwiching the conveyance path of the paper P. Here, the following roller 56 is formed as a heating roller, which is provided with a heat source such as a heater lamp or the like.

Herein, sprockets 48 (see FIG. 2, FIG. 3A and FIG. 3B), which are joined by a chain 50 (see FIG. 2), are mounted at rotation axes of the driving roller 22, the transfer roller 34, the driving roller 54 and the driving roller 58. That is, driving force from the motor that rotates the driving roller 22 is transmitted through the chain 50 to the transfer roller 34 and the driving rollers 54 and 58. Thus, the transfer roller 34 and the driving rollers 54 and 58 are driven.

As shown in FIG. 2, the transfer roller 34 and following roller 30 that structure the transfer roller pair 36 are arrange substantially in parallel. Bearings 44 are mounted to be relatively rotatable at each of two ends of a rotation axis 34A of the transfer roller 34, and bearings 46 are mounted to be relatively rotatable at each of two ends of a rotation axis 30A of the following roller 30. The bearings 44 and 46 are supported by support members (not shown) to be non-rotatable but movable in directions towards and away from one another.

That is, the transfer roller 34 and the following roller 30 are formed to be rotatable and movable toward and away from one another (i.e., and axis-to-axis separation can be increased and reduced).

The pressing mechanism 38 that presses the transfer roller 34 and the following roller 30 against one another is also provided at the transfer roller mechanism 18. The pressing mechanism 38 is provided with a magnet 62, a magnet 64, a compression coil spring 66 and a compression coil spring 68. The magnet 62, which serves as a first magnet structuring a second urging member, is mounted to be relatively rotatable at each of the two ends of the rotation axis 34A of the transfer roller 34. The magnet 64, which serves as a second magnet structuring the second urging member, is mounted to be relatively rotatable at each of the two ends of the rotation axis 30A of the following roller 30. The compression coil spring 66 serves as a resilient member structuring a first urging member, with one end being attached to the magnet 62. The compression coil spring 68 also serves as a resilient member structuring the first urging member, with one end being attached to the magnet 64.

The magnets 62 and 64 are supported by supporting members (not shown) to be non-rotatable but movable in directions towards and away from one another. The other end of the compression coil spring 66 is attached to a plate-like attachment portion 70 which is disposed below the magnet 62. Thus, the compression coil spring 66 is interposed between the magnet 62 and the attachment portion 70 in a resiliently deformed state.

The other end of the compression coil spring 68 is attached to a plate-like attachment portion 72 which is disposed above the magnet 64. Thus, the compression coil spring 68 is interposed between the magnet 64 and the attachment portion 72 in a resiliently deformed state.

Thus, upward resilient force of the compression coil springs 66 (i.e., in a direction of reducing the axis-to-axis separation between the transfer roller 34 and the following roller 30) acts on the two ends of the rotation axis 34A via the magnet 62. Meanwhile, downward resilient force of the compression coil springs 68 (i.e., in a direction of reducing the axis-to-axis separation between the transfer roller 34 and the following roller 30) acts on the two ends of the rotation axis 30A via the magnets 64. Therefore, the transfer roller 34 and the following roller 30 are urged in directions approaching one another (i.e., respective directions of reducing the axis-to-axis separation) by the compression coil springs 66 and 68.

Here, the magnet 62 and 64 are caused to have like poles opposing one another (for example, as illustrated, the south poles). Thus, a magnetic repulsion force is generated between the magnet 62 and the magnet 64. That is, an urging force in which the resilient forces of the compression coil spring 66 and 68 and the magnet repulsion forces generated by the magnets 62 and 64 are combined acts on the transfer roller 34 and the following roller 30.

Figure 3A:
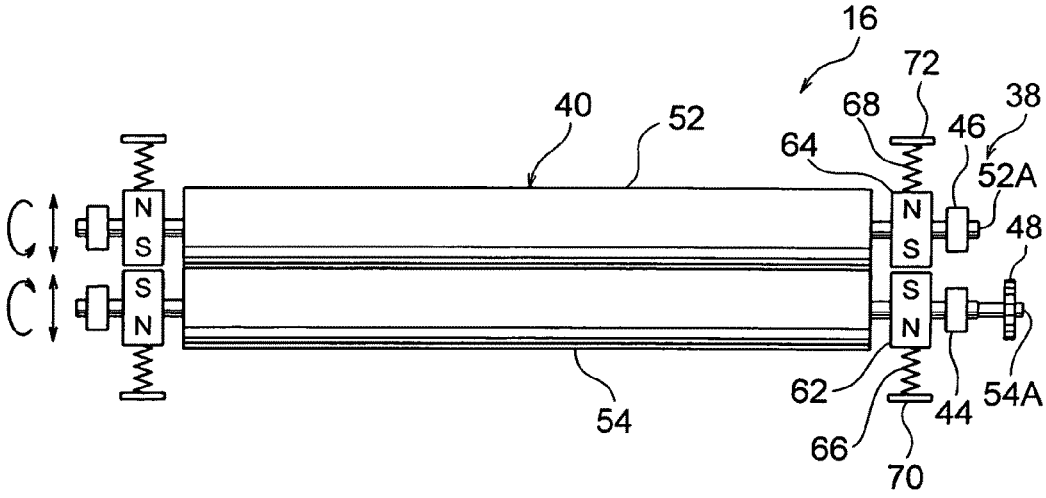
FIG. 3A is a front view showing a conveyance roller mechanism of the first exemplary embodiment of the present invention.

Further, as shown in FIG. 3A, the driving roller 54 and following roller 52 that structure the conveyance roller pair 40 are arranged substantially in parallel. The bearings 44 are mounted to be relatively rotatable at the two ends of a rotation axis 54A of the driving roller 54, and the bearing 46 are mounted to be relatively rotatable at each of two ends of a rotation axis 52A of the following roller 52. These bearings 44 and 46 are supported by support members (not shown) to be non-rotatable but movable in directions towards and away from one another.

That is, the driving roller 54 and the following roller 52 are supported to be rotatable and movable toward and away from one another (i.e., an axis-to-axis separation can be increased and reduced).

The pressing mechanism 38 is also provided at the conveyance roller mechanism 16. The magnet 62 thereof are mounted to be relatively rotatable at the two ends of the rotation axis 54A of the driving roller 54, and the magnet 64 are mounted to be relatively rotatable at the two ends of the rotation axis 52A of the following roller 52. Each compression coil spring 66 is interposed between the magnet 62 and attachment portion 70 in a resiliently deformed state, and each compression coil spring 68 is interposed between the magnet 64 and attachment portion 72 in a resiliently deformed state.

Thus, upward resilient force of these compression coil springs 66 (i.e., in a direction of reducing the axis-to-axis separation between the driving roller 54 and the following roller 52) acts on the two ends of the rotation axis 54A via the magnet 62. Meanwhile, downward resilient force of the compression coil springs 68 (i.e., in a direction of reducing the axis-to-axis separation between the driving roller 54 and the following roller 52) acts on the two ends of the rotation axis 52A via the magnet 64. Therefore, the driving roller 54 and the following roller 52 are urged in directions approaching one another (i.e., respective directions of reducing the axis-to-axis separation) by the compression coil springs 66 and 68.

Again, the magnets 62 and 64 are caused to have like poles opposing one another (for example, as illustrated, the south poles). Thus, a magnetic repulsion force is generated between the magnet 62 and the magnet 64. That is, an urging force in which the resilient forces of the compression coil springs 66 and 68 and the magnetic repulsion forces generated by the magnets 62 and 64 are combined acts on the driving roller 54 and the following roller 52.

Figure 3B:
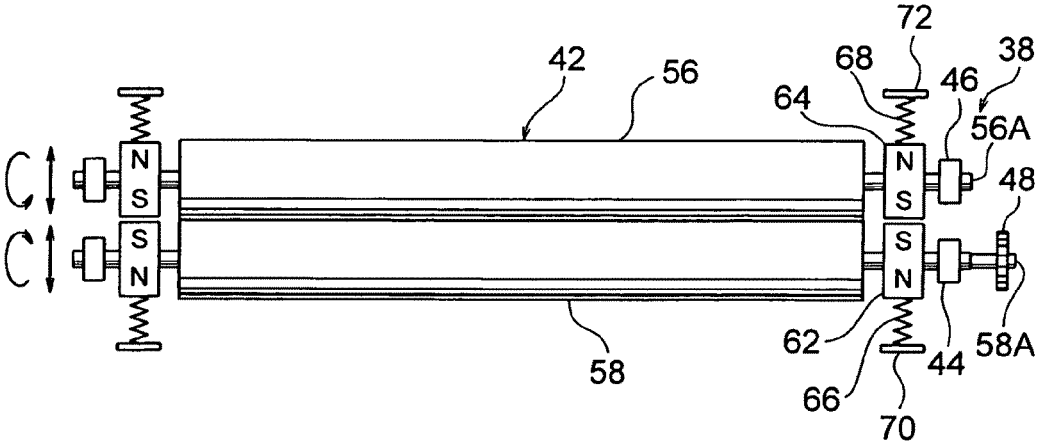
FIG. 3B is a front view showing a fixing roller mechanism of the first exemplary embodiment of the present invention.

Further, as shown in FIG. 3B, the driving roller 58 and following roller 56 that structure the fixing roller pair 42 are arranged substantially in parallel. The bearings 44 are mounted to be relatively rotatable at the two ends of a rotation axis 58A of the driving roller 58, and the bearings 46 are mounted to be relatively rotatable at the two ends of a rotation axis 56A of the following roller 56. These bearings 44 and 46 are supported by support members (not shown) to be non-rotatable but movable in directions towards and away from one another.

That is, the driving roller 58 and the following roller 56 are supported to be rotatable and movable towards and away from one another (i.e., an axis-to-axis separation can be increased and reduced).

The pressing mechanism 38 is also provided at the fixing roller mechanism 20. The magnets 62 thereof are mounted to be relatively rotatable at the two ends of the rotation axis 58A of the driving roller 58, and the magnets 64 are mounted to be relatively rotatable at the two ends of the rotation axis 56A of the following roller 56. Each compression coil spring 66 is interposed between the magnet 62 and attachment portion 70 in a resiliently deformed state, and each compression coil spring 68 is interposed between the magnet 64 and attachment portion 72 in a resiliently deformed state.

Thus, upward resilient force of these compression coil spring 66 (i.e., in a direction of reducing the axis-to-axis separation between the driving roller 58 and the following roller 56) acts on the two ends of the rotation axis 58A via the magnets 62. Meanwhile, downward resilient force of the compression coil spring 68 (i.e., in a direction of reducing the axis-to-axis separation between the driving roller 58 and the following roller 56) acts on the two ends of the rotation axis 56A via the magnets 64. Therefore, the driving roller 58 and the following roller 56 are urged in directions approaching one another (i.e., respective directions of reducing the axis-to-axis separation) by the compression coil springs 66 and 68.

Again, the magnets 62 and 64 are caused to have like poles opposing one another (for example, as illustrated, the south poles). Thus, a magnetic repulsion force is generated between the magnet 62 and the magnet 64. That is, an urging force in which the resilient forces of the compression coil spring 66 and 68 and the magnetic repulsion forces generated by the magnets 62 and 64 are combined acts on the driving roller 58 and the following roller 56.

Next, operation of the present exemplary embodiment will be described.

Referring to FIG. 1, paper P is conveyed to the conveyance roller pair 40 by conveyance roller pairs (not shown), which are disposed at a conveyance direction upstream side relative to the conveyance roller pair 40, and the paper P enters a nipping portion of the conveyance roller pair 40 that are being pushed against one another. Hence, the paper P is conveyed to the downstream side by friction force that is generated between the driving roller 54 and the following roller 52, and enters a nipping portion of the transfer roller pair 36.

Meanwhile, before a leading end of the paper P enters the nipping portion of the transfer roller pair 36, the inkjet recording heads 12Y, 12M, 12C and 12K start to eject ink droplets onto the horizontal portion 14H of the intermediate transfer belt 14, and form an ink image on the intermediate transfer belt 14.

In the nipping portion of the transfer roller pair 36, the paper P and the intermediate transfer belt 14 are pressed by the transfer roller 34 and the following roller 30, and the ink image on the intermediate transfer belt 14 is transferred to the paper P.

The paper P to which the ink image has been transferred is conveyed to the downstream side by friction force generated between the transfer roller 34 and the intermediate transfer belt 14, and enters a nipping portion of the fixing roller pair 42. In the nipping portion of the fixing roller pair 42, the paper P to which the ink image has been transferred is pressed and heated by the driving roller 58 and the following roller 56, and thus the ink image is fixed to the paper P. Hence, the paper P to which the ink image has been fixed is conveyed to the downstream side by friction force generated between the driving roller 58 and the following roller 56, and is ultimately ejected to outside the device.

Figure 4A:
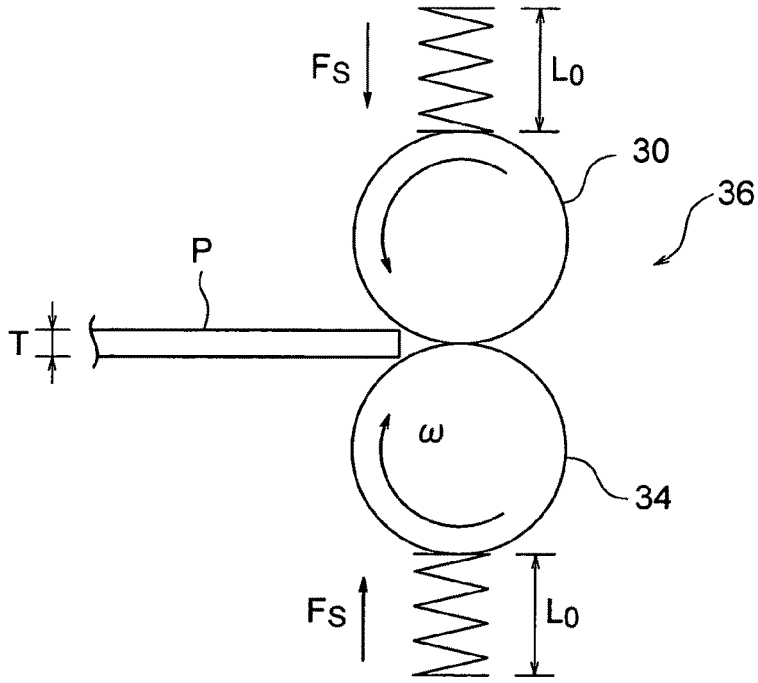
FIG. 4A and FIG. 4B are side views showing states in operation of a transfer roller.
Figure 4B:
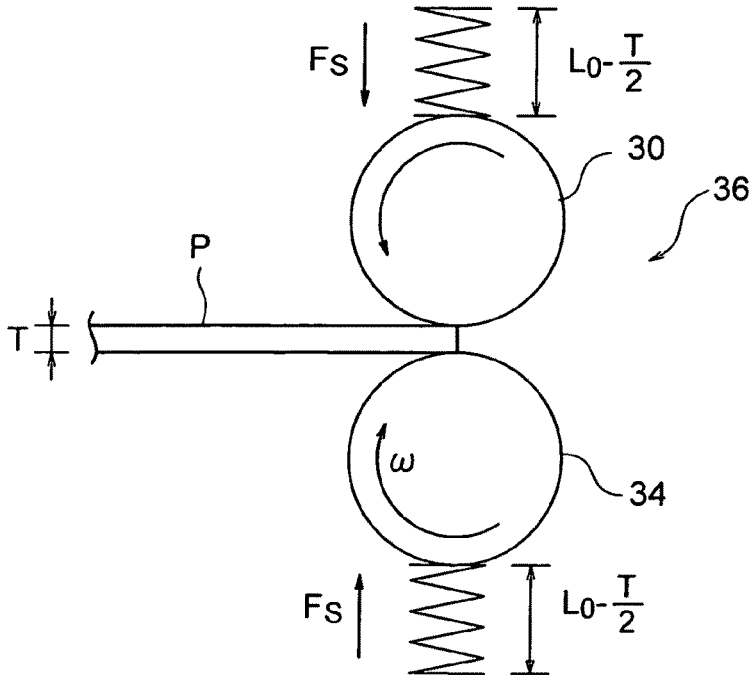

Here, as shown in FIG. 4A and FIG. 4B (note that the intermediate transfer belt 14 is omitted from these drawings), when the leading end of the paper P is entering the nipping portion of the transfer roller pair 36, the transfer roller 34 and the following roller 30 move apart by a thickness T of the paper P, with the compression coil springs 66 and 68 being compressed by T/2 each from lengths L0 of an initial state (i.e., the state in which the paper P is not interposed in the nipping portion). At this time, potential energies of the compression coil spring 66 and 68 increase, while rotation energies of the transfer roller 34 and following roller 30 decrease. Then, when the trailing end of the paper P is disengaging from the nipping portion of the transfer roller pair 36, the potential energies of the compression coil springs 66 and 68 decrease while the rotation energies of the transfer roller 34 and following roller 30 increase. These effects are based on the principle of conservation of dynamic energy.

Herein, this description applies to an example of a case in which the compression coil springs 66 and 68 are compressed by the same length, but this is not a limitation. The compression coil springs 66 and 68 may have different spring constants, and there will be similar operation in such a case.

Figure 5A:
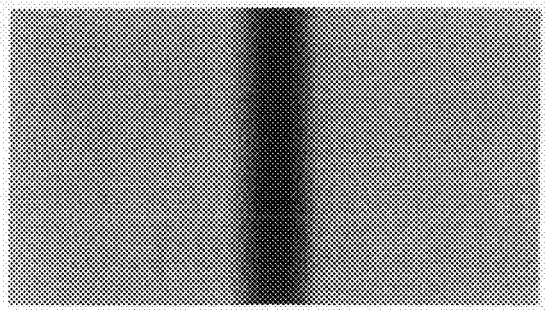
FIG. 5A is a view showing variations in density of an ink image on an intermediate transfer belt when paper has entered a nipping portion of a transfer roller pair.
Figure 5B:
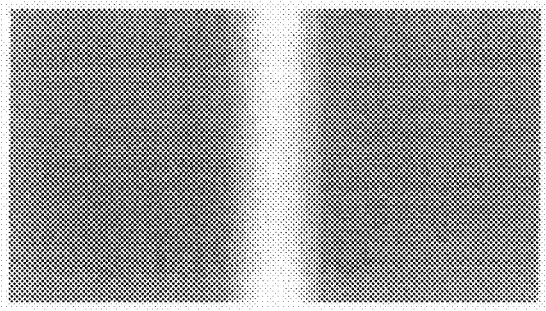
FIG. 5B is a view showing variations in density of the ink image on the intermediate transfer belt when the paper has disengaged from the nipping portion of the transfer roller pair.
Figure 5C:
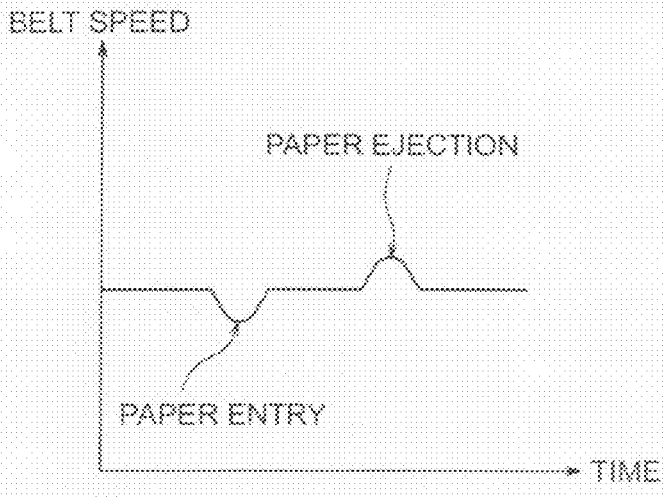
FIG. 5C is a graph showing a relationship between time in conveyance of the paper and speed of the intermediate transfer belt.

Thus, when the compression coil springs 66 and 68 are compressed by T/2 each due to the leading end of the paper P entering the nipping portion of the transfer roller pair 36, a rotation speed ω of the transfer roller 34 and the following roller 30 falls, and a turning speed of the intermediate transfer belt 14 falls (see the graph in FIG. 5C).

Then, when the compression coil springs 66 and 68 extend by T/2 each due to the trailing end of the paper P disengaging from the nipping portion of the transfer roller pair 36, the rotation speed ω of the transfer roller 34 and following roller 30 rises, and the turning speed of the intermediate transfer belt 14 rises (see the graph in FIG. 5C).

Therefore, when the leading end of the paper P enters the nipping portion of the transfer roller pair 36, an amount per unit area on the intermediate transfer belt 14 of ink that is ejected from the inkjet recording heads 12Y-12C and adheres onto the intermediate transfer belt 14 increases. As a result, a portion of the ink image on the intermediate transfer belt 14 has higher density than surrounding portions (see FIG. 5A).

Then, when the trailing end of the paper P disengages from the nipping portion of the transfer roller pair 36, an amount per unit area on the intermediate transfer belt 14 of ink that is ejected from the inkjet recording heads 12Y-12C and adheres onto the intermediate transfer belt 14 decreases. As a result, a portion of the ink image on the intermediate transfer belt 14 has lower density than surrounding portions.

In other words, when the leading end of the paper P enters the nipping portion of the transfer roller pair 36 and when the trailing end of the paper P disengages from the nipping portion of the transfer roller pair 36, strip-form density irregularities, ("banding") are formed in the ink image (see FIG. 5B).

Anyway, when the leading end of the paper P enters the nipping portion of the conveyance roller pair 40 or the fixing roller pair 42 and when the trailing end of the paper P disengages from the nipping portion of the conveyance roller pair 40 or the fixing roller pair 42, and the like, a rotation speed of the rollers structuring the roller pair changes, and the change in the rotation speed of the rollers is transmitted to the transfer roller 34 and the driving roller 22 through the chair 50. Therefore, when the leading end of the paper P enters the nipping portion of the conveyance roller pair 40 or the fixing roller pair 42 and when the trailing end of the paper P disengages from the nipping portion of the conveyance roller pair 40 or the fixing roller pair 42, or the like, the turning speed of the intermediate transfer belt 14 changes, and problems are caused by the turning speed of the intermediate transfer belt 14 changing.

In the present exemplary embodiment, when a change in rotation speed of the conveyance roller pair 40 or the fixing roller pair 42 is transmitted through the chain 50 to the transfer roller pair 36 and the turning speed of the intermediate transfer belt 14 changes, if, for example, a distance of the transfer roller pair 36 from the fixing roller pair 42 is shorter than a conveyance direction length of the paper P, or the like, the conveyance speed of the paper P itself will change, and problems such as transfer misalignment and the like will occur.

Moreover, the compression amount T/2 of the compression coil spring 66 and 68 changes in accordance with whether the paper P is thick or thin (whether the thickness T is large or small), and a resilient force Fs of the compression coil springs 66 and 68 (i.e., a transfer pressure of see transfer roller pair 36) changes. Specifically, the greater the thickness T of the paper P, the greater the resilient forces Fs of the compression coil springs 66 and 68, and the smaller the thickness T of the paper P, the smaller the resilient force Fs of the compression coil springs 66 and 68.

Figure 6:
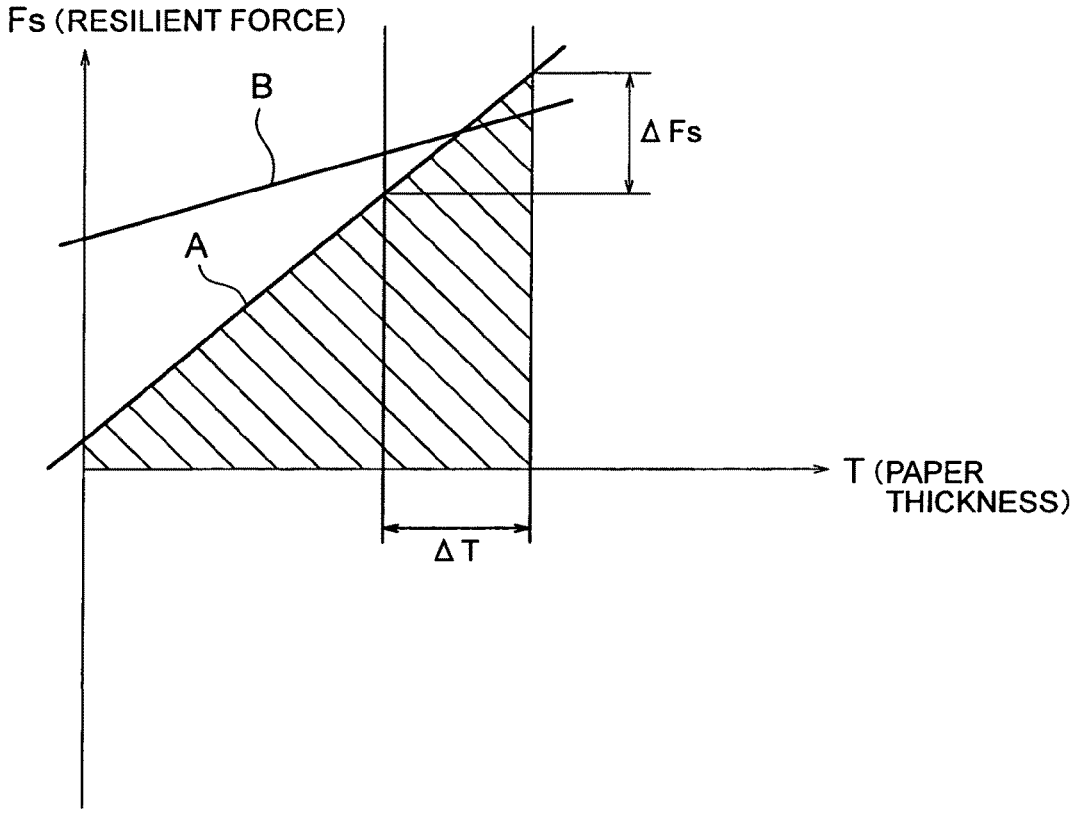
FIG. 6 is a graph showing a relationship between thickness of paper and resilient force of a compression coil spring.

Herein, as shown by the graph in FIG. 6, the resilient force Fs of the compression coil springs 66 and 68 increases linearly with increases in the thickness T of the paper P (i.e., increases in the compression amount T/2 of the compression coil spring 66 and 68).

Therefore, to decrease a potential energy quantity during nipping of the paper P (which corresponds to the area of the region shown with shading lines in the graph) in order to suppress changes in the rotation speed ω of the transfer roller 34 and the following roller 30, it would be sufficient to increase resilience coefficients of the compression coil springs 66 and 68 (shown by the solid line A in the graph of FIG. 6). However, in such a case, variations ΔFs in the resilient force Fs of the compression coil spring 66 and 68 due to differences in thickness T of the paper P would be larger, and variations in transfer pressure of the transfer roller pair 36 would be larger.

On the other hand, to suppress variations in the transfer pressure of the transfer roller pair 36 due to difference ΔT in thickness of the paper P, it would be sufficient to make the resilience coefficients of the compression coil spring 66 and 68 smaller (shown by the solid line B in the graph of FIG. 6). However, in such a case, it would be necessary to increase a resilient force Fs of the compression coil springs 66 and 68 in the initial state (the state in which the paper P is not interposed in the nipping portion) in order to obtain equivalent transfer pressure to the above-described case in which the resilience coefficients are large. Therefore, a potential energy quantity in the nipping state (the state in which the paper P is interposed at the nipping portion of the transfer roller pair 36) would be larger, and hence variations in the rotation speed ω of the transfer roller 34 and the following roller 30 would be larger.

Figure 7:
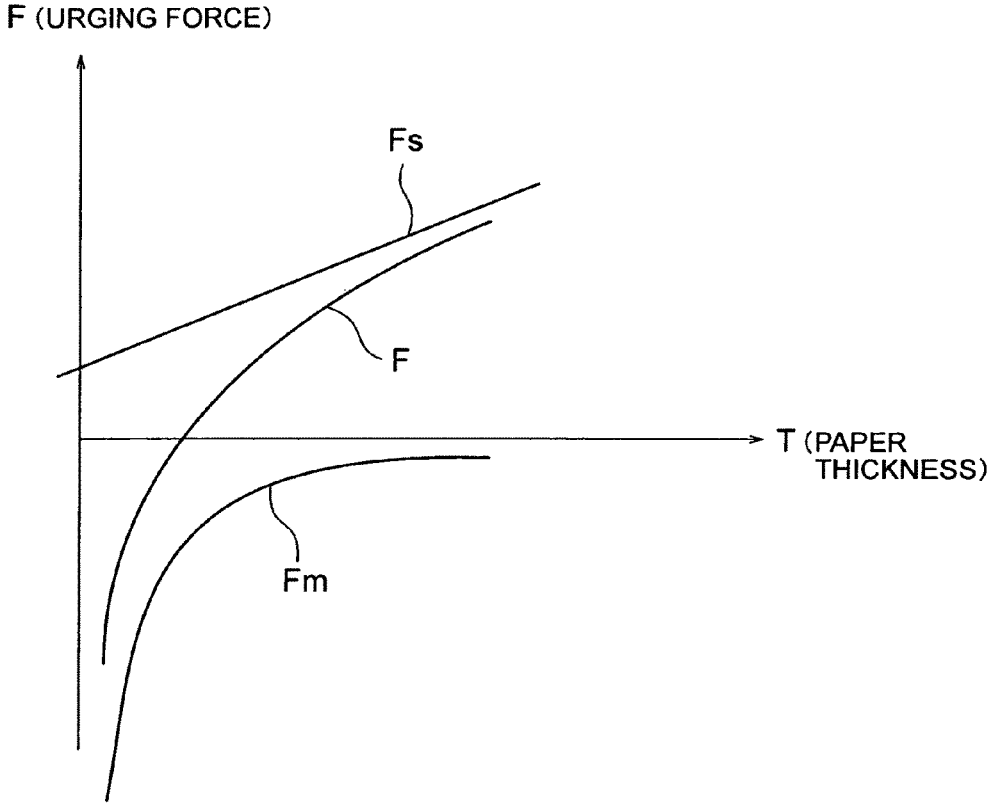

By contrast, with the present exemplary embodiment, as shown by the graph in FIG. 7 (which shows forces in a direction of reducing the axis-to-axis separation between the transfer roller 34 and the following roller 30 as positive direction forces), a magnetic repulsion force Fm of the magnets 62 and 64 decreases non-linearly with increases in the thickness T of the paper P (i.e., widening of a separation distance between the magnets 62 and 64), with the rate of decrease falling (see, for example, Iwanami Shoten Introductory Physics Course 3, Electromagnetism I: Electric Fields and Magnetic Fields). Therefore, an urging force F in which the resilient force Fs and the magnetic repulsion force Fm are combined increases non-linearly with increases in the thickness T of the paper P, with the rate of increase falling.

Figure 8:
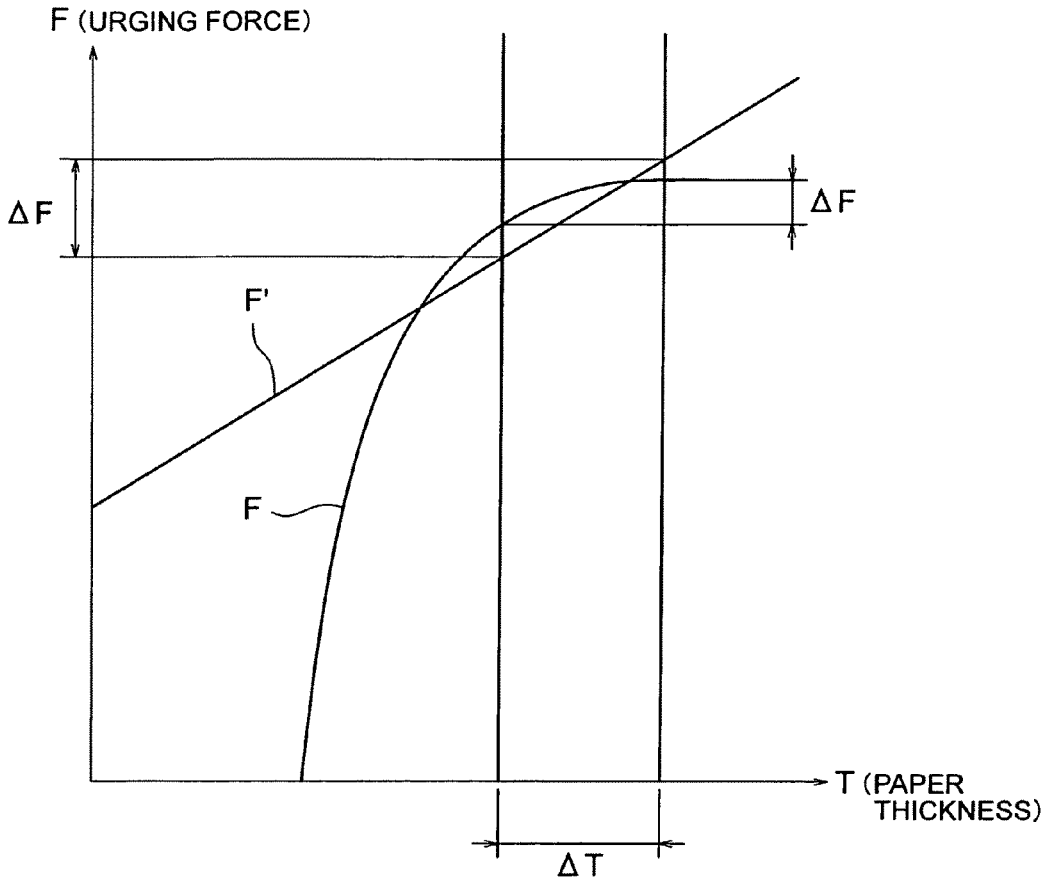

Here, as shown in the graph in FIG. 8, the urging force F is smaller in the initial state than a resilient force F' of a spring that would generate a transfer pressure equivalent to the urging force F. Further, a rate of increase in the urging force F when changing from the initial state to the nipping state is higher than for the resilient force F', and a rate of increase in the urging force F associated with an increase in thickness T of paper P in the nipping state is equivalent or lower than for the resilient force F'.

Therefore, compared to a case in which the transfer roller 34 and following roller 30 are pressured using only springs that generate a pressure force equivalent to the present exemplary embodiment, a potential energy quantity of the springs is reduced, and difference ΔF in magnitude of the urging force F due to differences in thickness T of the paper P are reduced.

Herein, it is sufficient for the urging force F to realize a desired non-linear characteristic for cases in which the axis-to-axis separation between the transfer roller 34 and the following roller 30 is within a range of changes at times of nipping the paper P. There is no need to realize the desired non-linear characteristics so far as cases in which the axis-to-axis separation between the transfer roller 34 and the following roller 30 goes beyond the range of changes at times of nipping the paper P.

Next, a second exemplary embodiment of the present invention will be described. Herein, structures that are the same as in the first exemplary embodiment will be assigned the same reference numerals, and descriptions thereof will not be given.

Figure 9:
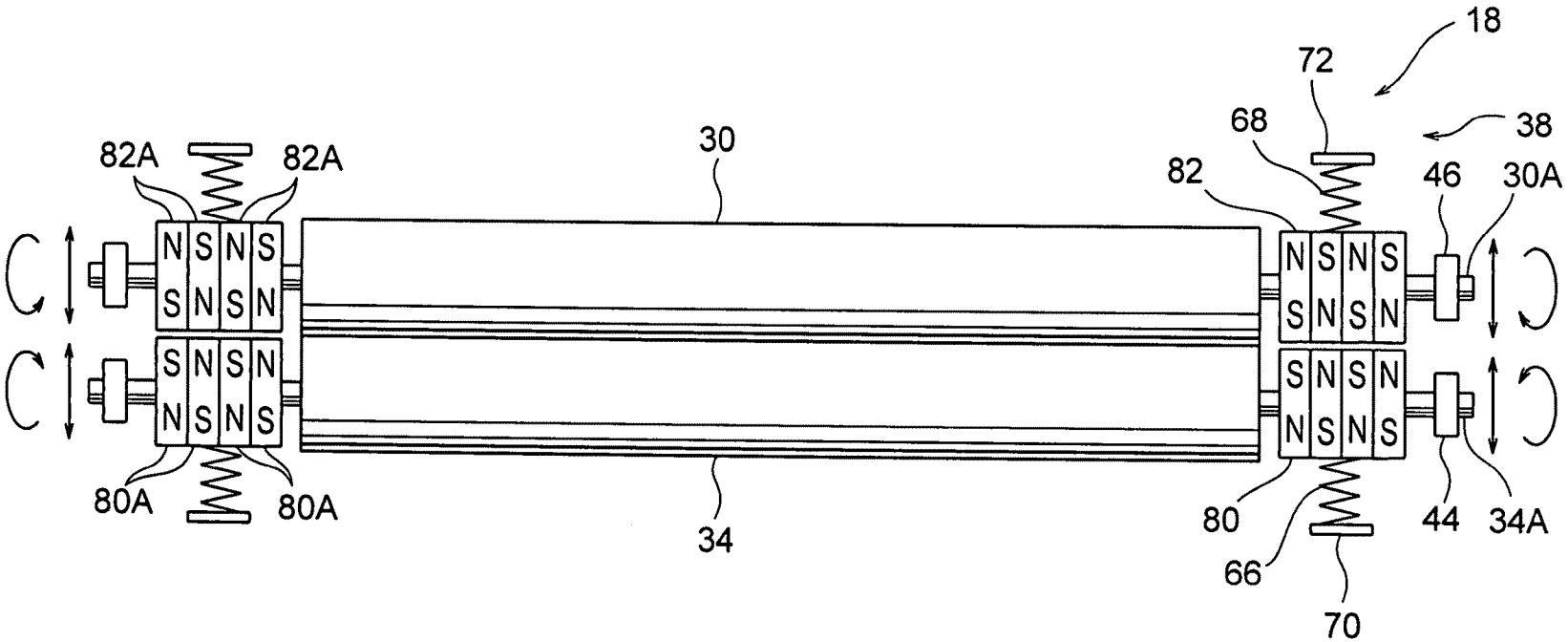
FIG. 9 is a front view showing a transfer roller pair relating to a second exemplary embodiment of the present invention.

As shown in FIG. 9, in the present exemplary embodiment, magnets 80 and 82 are provided instead of the magnets 62 and 64. The magnet 80 is structured by a plurality (for example, as shown in the drawing, four) of magnetic portions 80A, which are arranged along the axial direction of the transfer roller 34. Each magnetic portion 80A has different polarities at a side thereof at which the magnet 82 is disposed and at an opposite side. The magnet 82 side (and the opposite side) of each of the plurality of magnetic portions 80A has a different polarity from the neighboring magnetic portion(s) 80A. Thus, the magnetic portions 80A are structured with south poles and north poles arranged alternatingly.

The magnet 82 is structured by a plurality (for example, as shown in the drawing, four) of magnetic portions 82A, which are arranged along the axial direction of the following roller 30. Each magnetic portion 82A has different polarities at the side thereof at which the magnet 80 is disposed and at the opposite side. The magnet 80 side (and the opposite side) of each of the plurality of magnetic portions 82A has a different polarity from the neighboring magnetic portion(s) 82A. Thus, the magnetic portions 82A are structured with south poles and north poles arranged alternatingly.

The magnet 80 and the magnet 82 are arranged with the magnetic portions 80A and the magnetic portions 82A opposing one another, and the magnetic portions 80A and magnetic portions 82A that oppose one another have like polarities at the opposing sides thereof. Therefore, magnetic repulsion force is generated between the magnet 80 and the magnet 82. An urging force in which the resilient force of the compression coil springs 66 and 68 and the magnetic repulsion force due to the magnets 80 and 82 are combined acts on the transfer roller 34 and the following roller 30.

In the present exemplary embodiment, those of the magnetic portions 80A and magnetic portions 82A that are disposed in diagonal directions from one another across the gap (for example, the left most magnetic portion 80A in the drawing and the magnetic portion 82A that is adjacent to the leftmost magnetic portion 82A) are disposed so as not to overlap when viewed in the direction of movement of the magnets. However, as long as the magnetic repulsion force is generated between the magnetic portions 80A and magnetic portions 82A that oppose one another across the gap in the magnet movement direction, the diagonally facing magnetic portions 80A and magnetic portions 82A could be disposed so as to partially overlap when viewed in the magnet movement direction.

Next, operation of the present exemplary embodiment will be described.

The transfer roller 34 and the following roller 30 are pushed against one another by the urging force in which the resilient force of the compression coil springs 66 and 68 and the magnetic repulsion force generated between the magnets 80 and the magnets 82 are combined.

Figure 10:
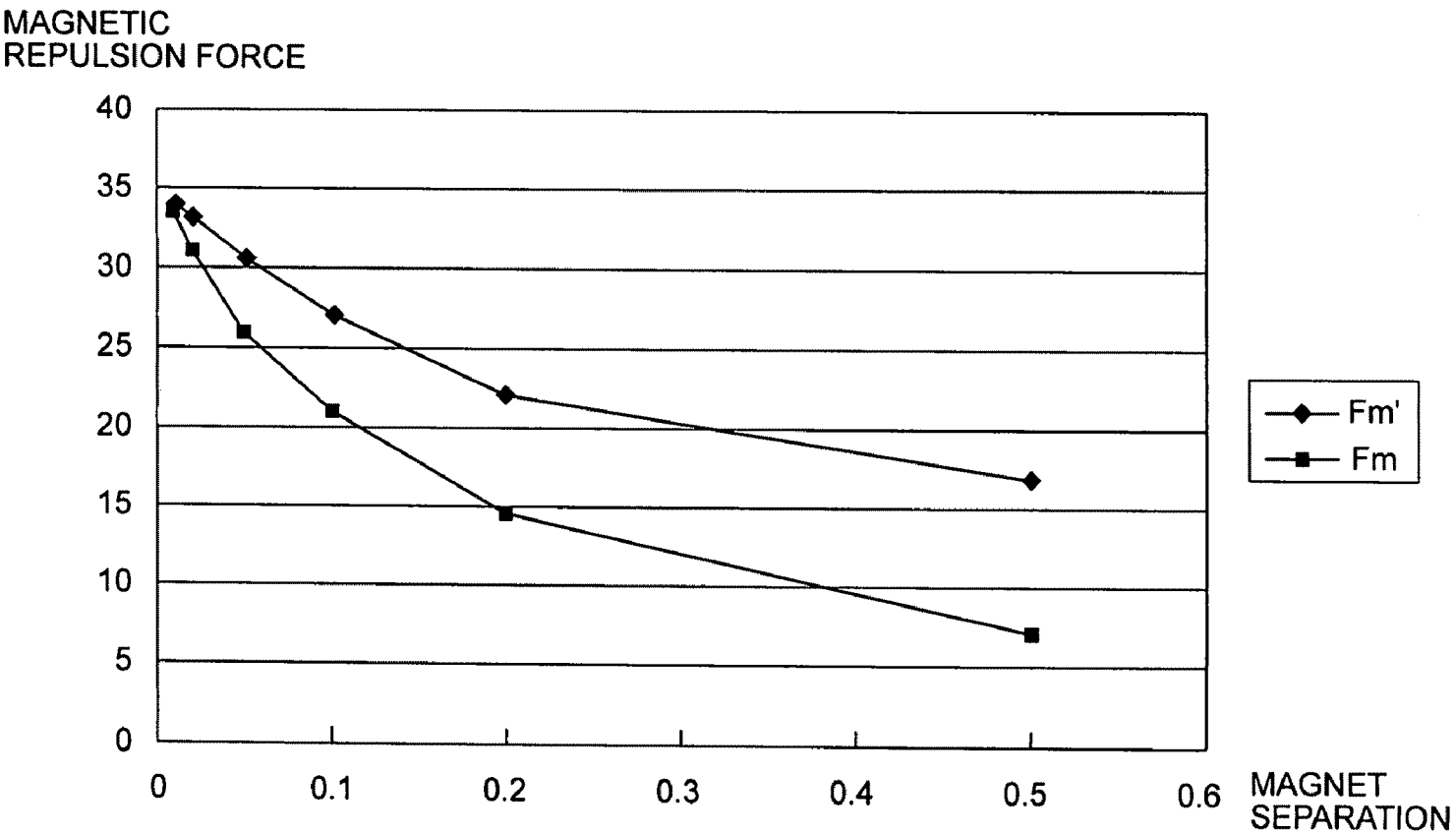
FIG. 10 is a graph showing relationship between separations between magnets and magnetic repulsion forces.

Here, as shown by the graph of FIG. 10, the magnetic repulsion force between the magnets 80 and 82 decreases non-linearly with increases in the axis-to-axis separation of the transfer roller 34 and the following roller 30, with the rate of decrease falling. Therefore, the urging force in which the resilient force and the magnetic repulsion force are combined increases non-linearly with increases in the axis-to-axis separation of the transfer roller 34 and the following roller 30, with the rate of increase falling.

Figure 11A:
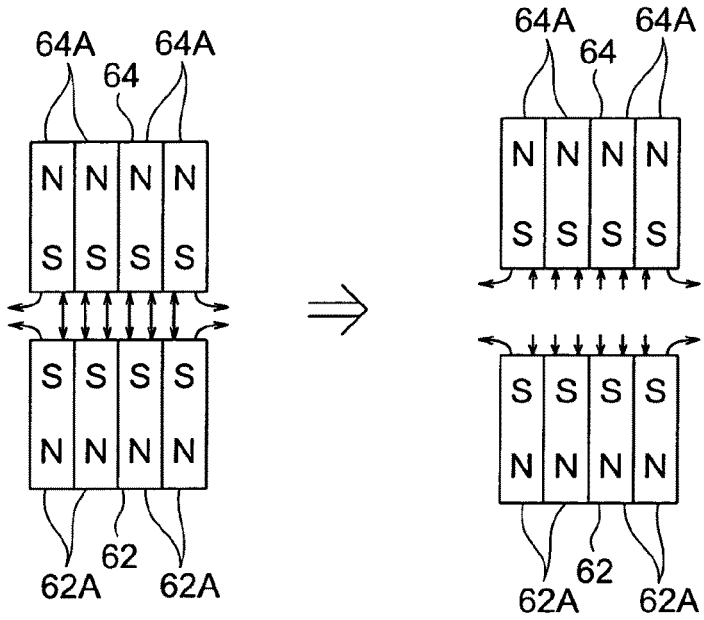
FIG. 11A is a view showing operation of magnets in the first exemplary embodiment.
Figure 11B:
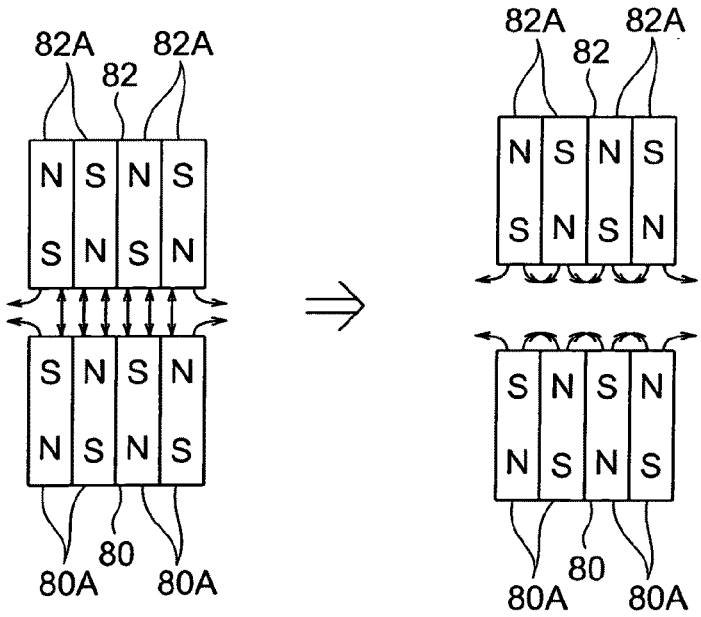
FIG. 11B is a view showing operation of magnets in the second exemplary embodiment.

Now, as shown in FIG. 11B, between the magnet 80 and the magnet 82, there are magnetic force lines that join between the magnetic portions that oppose across the gap in the magnet movement direction, magnetic force lines that join neighboring magnetic portions within the same magnets, and magnetic force lines that join between magnetic portions that are disposed in diagonal directions from one another across the gap.

When the separation distance between the magnet 80 and the magnet 82 is small (for example, when there is no paper P interposed in the nipping portion of the transfer roller pair 36, when the paper P is thin paper, or the like), strengths of magnetic force lines between the magnet 80 and the magnet 82 that join between the magnetic portions that oppose across the gap in the magnet movement direction are strong. However, as the separation distance between the magnet 80 and the magnet 82 becomes larger (for example, when paper P that is thick paper is interposed in the nipping portion of the transfer roller pair 36 or the like), strengths of magnetic force lines that join between neighboring magnetic portions within the same magnet and magnetic force lines that join between the magnetic portions that are disposed in diagonal directions across the gap becomes stronger.

In contrast, as shown in FIG. 11A, between the magnet 62 and the magnet 64 of the first exemplary embodiment, there are only magnetic force lines that extend in the magnet movement direction. These magnetic force lines are similar to the above-mentioned magnetic force lines that join between the magnetic portions that oppose across the gap in the magnet movement direction.

Thus, strengths of the magnetic force lines extending in the magnet movement direction between the magnet 62 and the magnet 64 are large regardless of whether the separation distance between the magnet 62 and the magnet 64 is large or small.

Therefore, as shown in the graph of FIG. 10, a magnetic repulsion force Fm that is generated between the magnet 80 and the magnet 82 has a higher rate of decrease with lengthening of the magnet separation distance than a magnetic repulsion force Fm' that is generated between the magnet 62 and the magnet 64. That is, the magnetic repulsion force Fm has higher non-linearity.

Therefore, the urging force in which the magnetic repulsion force generated between the magnets 80 and magnets 82 and the resilient force of the compression coil springs 66 and 68 are combined changes with higher non-linearity than the urging force of the first exemplary embodiment.

Hereabove, particular exemplary embodiments of the present invention have been described in detail. However, the present invention is not to be limited to these exemplary embodiments, and it will be clear to those skilled in the art that numerous other exemplary embodiments are possible within the scope of the present invention. For example, in the present exemplary embodiments, the present invention has been described by taking an inkjet recording device as an example, but the present invention is also applicable to recording devices that use electrophotography systems. That is, it is possible to use other image forming means instead of the inkjet recording heads, such as an image forming section that uses an electrophotography system or the like.

Further, it is also possible to use other resilient members instead of the compression coil springs, such as tension coil springs or the like, to use other urging units instead of the resilient members, such as air cylinders (pneumatic springs) or the like, to use electromagnets instead of permanent magnets, or to use means that generate repulsion force electrostatically instead of the magnets.

Further, in the present exemplary embodiments, the roller pairs are formed as driving roller pairs, but could be following roller pairs. Moreover, the present exemplary embodiments have structures in which both of a pair of rollers are urged in directions to approach one another by the compression coil springs, but structures are also possible in which the position of the axis of one of a pair of rollers does not change and the other roller is urged by an urging unit relative to the one roller.

As mentioned above, the foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A roller mechanism comprising:

a pair of rollers that oppose one another sandwiching a conveyance path of a sheet material, and are provided to be capable of increasing and reducing an axis-to-axis separation thereof; and an urging unit that urges at least one of the pair of rollers in a direction of reducing the axis-to-axis separation of the pair of rollers with an urging force that increases with an increase in the axis-to-axis separation of the pair of rollers, and presses the sheet material with the pair of rollers, the urging unit increasing the urging force non-linearly, with a rate of increase of the urging force falling as the axis-to-axis separation of the pair of rollers increases within a range of changes at times of sheet material-pressing.

2. The roller mechanism of claim 1, wherein the urging unit comprises:

a first urging member that urges the at least one of the pair of rollers in the direction of reducing the axis-to-axis separation of the pair of rollers with a first urging force, which increases linearly with an increase in the axis-to-axis separation of the pair of rollers within the range of changes at times of sheet material-pressing; and a second urging member that urges the at least one of the pair of rollers in a direction of increasing the axis-to-axis separation of the pair of rollers with a second urging force, which decreases with an increase in the axis-to-axis separation of the pair of rollers, the second urging member decreasing the second urging force non-linearly, with a rate of decrease of the second urging force falling as the axis-to-axis separation of the pair of rollers increases with the range of changes at times of sheet material-pressing.

3. The roller mechanism of claim 2, wherein the first urging member includes a resilient member, and the second urging member includes a first magnet that is provided at one of the pair of rollers, and a second magnet that is provided at the other of the pair of rollers to oppose the first magnet, a magnetic repulsion force being generated between the first magnet and the second magnet.

4. The roller mechanism of claim 3, wherein mutually opposing portions of the first magnet and the second magnet are structured so as to substantially have like polarities.

5. The roller mechanism of claim 3, wherein a portion of the first magnet that opposes the second magnet and a portion of the second magnet that opposes the first magnet are both structured with different polarities being alternatingly arrayed.

6. The roller mechanism of claim 3, wherein the resilient member includes a coil spring.

7. A roller mechanism comprising:

a pair of rollers that oppose one another sandwiching a conveyance path of a sheet material, and are provided to be capable of increasing and reducing an axis-to-axis separation thereof:

a resilient member that urges the pair of rollers in directions of reducing the axis-to-axis separation and presses the sheet material with the pair of rollers;

a first magnet that is provided at one of the pair of rollers; and a second magnet that is provided at the other of the pair of rollers to oppose the first magnet, a magnetic repulsion force being generated between the first magnet and the second magnet.

8. The roller mechanism of claim 7, wherein mutually opposing portions of the first magnet and the second magnet are structured so as to substantially have like polarities.

9. The roller mechanism of claim 7, wherein a portion of the first magnet that opposes the second magnet and a portion of the second magnet that opposes the first magnet are both structured with different polarities being alternatingly arrayed.

10. The roller mechanism of claim 7, wherein the resilient member includes a coil spring.

11. The roller mechanism of claim 1, wherein the pair of rollers presses the sheet material and generates friction force between the rollers and the sheet material, and conveys the sheet material with the friction force.

12. The roller mechanism of claim 7, wherein the pair of rollers presses the sheet material and generates friction force between the rollers and the sheet material, and conveys the sheet material with the friction force.

13. The roller mechanism of claim 1, wherein the pair of rollers presses an image-bearing body that bears an image against the sheet material for transferring the image borne on the image-bearing body to the sheet material.

14. The roller mechanism of claim 7, wherein the pair of rollers presses an image-bearing body that bears an image against the sheet material for transferring the image borne on the image-bearing body to the sheet material.

15. The roller mechanism of claim 1, wherein the pair of rollers presses the sheet material, which bears an image, for fixing the image to the sheet material.

16. The roller mechanism of claim 7, wherein the pair of rollers presses the sheet material, which bears an image, for fixing the image to the sheet material.

17. An image forming apparatus comprising:

an image forming unit that forms an image on a sheet material; and a roller mechanism, the roller mechanism including:

a pair of rollers that oppose one another sandwiching a conveyance path of the sheet material, and are provided to be capable of increasing and reducing an axis-to-axis separation thereof; and an urging unit that urges at least one of the pair of rollers in a direction of reducing the axis-to-axis separation of the pair of rollers with an urging force that increases with an increase in the axis-to-axis separation of the pair of rollers, and presses the sheet material with the pair of rollers, the urging unit increasing the urging force non-linearly, with a rate of increase of the urging force falling as the axis-to-axis separation of the pair of rollers increases within a range of changes at times of sheet material-pressing.

* * * * *